US005845517A

United States Patent [19]

Attlfellner

[11] Patent Number: 5,845,517

[45] Date of Patent: Dec. 8, 1998

[54] PROCESS AND DEVICE FOR AIR SEPARATION BY LOW-TEMPERATURE RECTIFICATION

[75] Inventor: Helmut Attlfellner, Bayville, N.Y.

[73] Assignee: Linde Aktiengesellschaft, Wiesbaden, Germany

[21] Appl. No.: 695,601

[22] Filed: Aug. 12, 1996

[30] Foreign Application Priority Data

Aug. 11, 1995 [DE] Germany ..... 195 29 681.8

[51] Int. Cl.[6] ..... F25J 3/04

[52] U.S. Cl. ..... 62/644; 62/915; 62/653

[58] Field of Search ..... 62/644, 645, 648, 62/649, 915, 940, 653

[56] References Cited

U.S. PATENT DOCUMENTS

| | | | |
|---|---|---|---|
| 3,731,495 | 5/1973 | Coveney . | |
| 3,950,957 | 4/1976 | Zakon | 62/644 |
| 4,224,045 | 9/1980 | Olszewski et al. | 62/915 X |
| 4,555,256 | 11/1985 | Skolaude et al. . | |
| 5,036,672 | 8/1991 | Rottmann et al. . | |
| 5,251,451 | 10/1993 | Xu et al. . | |
| 5,437,160 | 8/1995 | Darredeau et al. | 62/915 X |

FOREIGN PATENT DOCUMENTS 01260283 10/1989 Japan .

*Primary Examiner*—Christopher Kilner
*Attorney, Agent, or Firm*—Millen, White, Zelano, & Branigan, P.C.

[57] ABSTRACT

An air stream is compressed and divided into a first partial stream (4) used as the feed air stream for a low-temperature air rectification system (16), and a second partial stream (5) used as an oxidation agent in a chemical reaction (6). The waste gas from the chemical reaction is work expanded (9). The first partial stream (4) is introduced into one of rectifying columns (17, 18). A liquid product stream is withdrawn from one (18) of the rectification columns, compressed (28) and vaporized against a further compressed (31, 33) process stream (15) from the low-temperature rectification. At least a portion of the mechanical energy resulting from the work expansion (9) of the waste gas of chemical reaction (6) is used for further compression (31, 33) of the process stream.

18 Claims, 2 Drawing Sheets

PROCESS AND DEVICE FOR AIR SEPARATION BY LOW-TEMPERATURE RECTIFICATION

BACKGROUND OF THE INVENTION

This invention relates to a process for the low-temperature rectification of air wherein compressed air from the air feed compressor is split, with one fraction being passed to the air separation plant and another fraction being used in a chemical reaction.

By compressing the feed air for the air separation facility together with the air needed in the chemical process, the system is integrated. (It is also optional to use producer gas in addition to the compressed air for the chemical reaction.) The mechanical energy generated by the work expansion of waste gases from the chemical reaction is often used to produce electrical energy. Optionally, mechanical energy can also be used directly for air compression. The chemical reaction can involve, for example, coal gasification or combustion.

In the process, one of the products is withdrawn as a liquid from the rectification, compressed in the liquid state and then vaporized against a correspondingly compressed process stream, with the latter being at least partially condensed. By virtue of this internal (in-cycle) compression, it is possible to produce a gaseous product, as often needed for a chemical process, with a relatively low equipment expense.

A process of the above-mentioned type is known from EP-A-0 584 419, wherein a portion of the compressed air is fed to a combustion chamber, and the balance is used as feed air for the air separation facility. Liquid oxygen is withdrawn from the bottom of the low-pressure column of a double rectification column, compressed in a pump and vaporized against further compressed air.

An object of this invention is to configure such a process and a corresponding facility so that the process can be operated in an energy-wise efficient manner.

Upon further study of the specification and appended claims, other objects and advantages of the invention will become apparent.

SUMMARY OF THE INVENTION

The objects are achieved in that at least part of the mechanical energy generated during the expansion of the waste gas from the chemical reaction is used for further compression of the process stream that is used to vaporize the liquid product stream by indirect heat exchange. Stated more comprehensively, the invention provides a process for air separation by low-temperature rectification in a rectification column system having at least one rectifying column, comprising the following steps:

(a) compressing an air stream to at least the highest pressure prevailing inside the rectifying column system;

(b) dividing the result compressed air stream into a first partial stream passed as feed air stream into the rectifying column system, and into a second partial stream that is fed to a chemical reaction zone as an oxidation agent;

(c) work expanding at least a portion of waste gas resulting from said chemical reaction zone;

(d) cooling said first partial stream to about saturation temperature and introducing resultant cooled partial stream into a rectifying column;

(e) withdrawing a liquid product stream from a rectifying column;

(f) increasing the pressure of the liquid product stream;

(g) compressing a process stream from the low-temperature rectification to a pressure above the highest pressure occurring in the rectifying column system, and;

(h) vaporizing the liquid product stream by indirect heat exchange with at least a portion of the process stream, and wherein the improvement comprises (i) employing at least a portion of the resultant mechanical energy generated in work expansion of waste gas from the chemical reaction zone in step (c) for further compression of a process stream in step (g).

Thus, no external energy is needed for further compression of the process stream. By simple mechanical coupling, by a common shaft, of the expansion machine for the waste gas (generally a gas turbine) and a booster for further compression, the output generated during the expansion can be transferred to the booster. Possibly excess mechanical energy can be taken up by a braking fan, for example, but it is better to convert it into electrical energy by coupling a generator to the common shaft.

In addition, a portion of the mechanical energy generated during the work expansion of the waste gas of the chemical reaction can be transferred to other compressors, in particular for the combined compression of the air stream. A generator/electric motor may be used to balance a possible excess/deficit of mechanical energy to drive the two or more compressors.

The process stream used for vaporizing the liquid product can be based on a portion of the first partial stream of compressed air or on a nitrogen product stream from a rectifying column. In the first case, preferably a portion of the feed air, compressed to at least rectifying pressure, is compressed, partially or completely condensed against the vaporizing liquid product and then fed into a rectifying column. In the second case, gaseous nitrogen is withdrawn, for example, from the high pressure column of a double rectification column, further compressed, at least partially condensed, and fed as reflux to a rectifying column and/or withdrawn as liquid product.

It is further advantageous if part of the further compressed process stream, which is not brought into indirect heat exchange with the vaporizing liquid product stream, is work expanded. In this way, the vaporization of the internally compressed product and a cooling cycle that is operated, for example, with air or nitrogen, can be integrated.

Work generated in the cooling cycle can be used for further compression of the process stream, for example by a second booster that is mechanically coupled with the work expansion machine for the process stream. This second booster can be upstream or downstream from the booster coupled with the gas turbine.

If the rectifying column system comprises a double column consisting of a high pressure column and a low-pressure column, the liquid product stream can be withdrawn from the bottom zone of the low-pressure column so that gaseous oxygen is obtained as an internally compressed product. Alternatively or additionally, nitrogen (for example from the top of the high pressure column) or argon from a connected argon rectification column can be compressed in liquid form and vaporized against the further compressed process stream. Of course it is also possible to store the liquid product(s) temporarily before or after the internal compression in a liquid storage tank.

The invention also relates to a facility having equipment for conducting process of the invention. Accordingly, the invention provides in a facility for the low-temperature rectification of air, said facility comprising a rectifying column system having at least one rectifying column, and (a) an air compressor having an inlet and outlet;

(b) a first air line that leads from the outlet of air compressor through a main heat exchanger to said rectifying column system;

(c) a second air line that leads from the outlet of said air compressor to a chemical reactor having an inlet and outlet;

(d) a gas turbine having an inlet connected to the outlet of chemical reactor;

(e) a liquid product line for withdrawal of a liquid product stream said rectifying column system;

(f) means to increase the pressure in the liquid product stream;

(g) means to further compress a process stream of the low-temperature rectification to a pressure above the highest pressure occurring in rectifying column system; and (h) means for vaporizing the liquid product stream by indirect heat exchange with at least a portion of the further compressed process stream, the improvement comprising (i) means to transfer at least a portion of the mechanical energy generated in a gas turbine said means to further compress the process stream.

BRIEF DESCRIPTION OF THE DRAWINGS

The invention and further details of the invention are explained in further detail below based on the embodiments represented in the drawings, wherein.

DETAILED DESCRIPTION OF THE INVENTION

Figure 1:
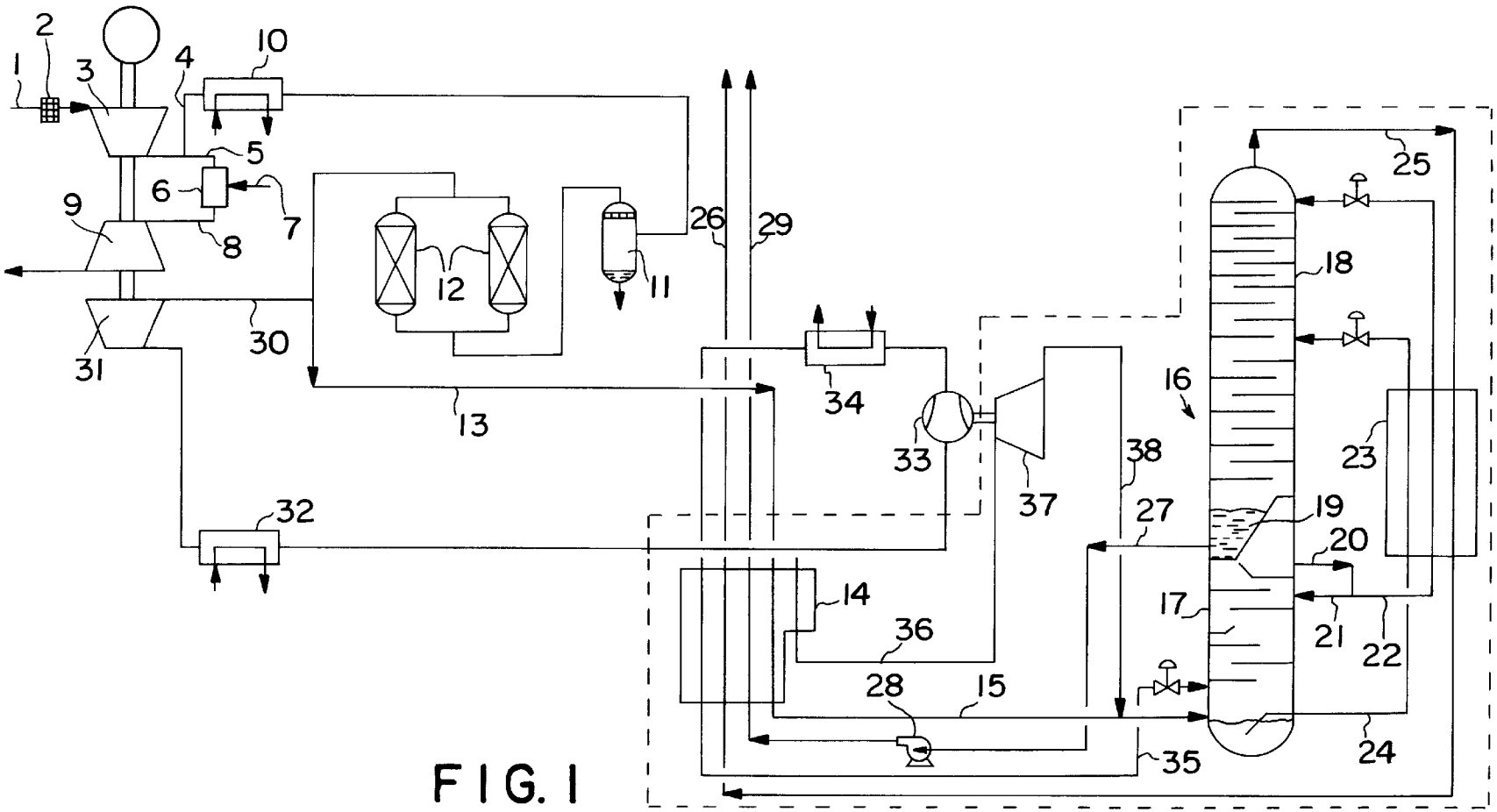
FIG. 1 is a schematic flow sheet of an especially preferred embodiment of the process and the device according to the invention, in which the secondarily compressed process stream is based on a portion of the compressed feed air.

First there are described, based on FIG. 1, those process steps and equipment parts that are common to both embodiments.

Atmospheric air is taken in at 1 by a filter 2, compressed in an air compressor 3 to a pressure of 5 to 14 bars, preferably 5.5 to 6.5 bars, and then divided into a first partial stream 4 and a second partial stream 5. Second partial stream 5 is fed to a combustion chamber 6 and burned there with a fuel 7. Waste gas 8 from the combustion is expanded, producing work, in a gas turbine 9. The amount of the second partial stream will be subject to the particular conditions of each plant. For example, the first partial stream 4 consists of about 10 to 15% of the total air 1 compressed in compressor 3, the remainder of the total air 1 forming the second partial stream 5.

The first partial stream 4 is freed from the heat of compression in secondary cooler 10, further cooled in direct heat exchange with water 11, purified in a molecular sieve unit 12 and fed by line 13 to main heat exchanger 14. The air, cooled to about the saturation temperature, is fed by line 15 to high pressure column 17 of a double rectification column 16, preferably directly above the bottom. The operating pressure of high pressure column 17 is 5 to 14 bars, preferably 5.5 to 6.5 bars. Gaseous nitrogen accumulating at the top of high pressure column 17 is liquefied in main condenser 19 against vaporizing oxygen from the bottom of low-pressure column 18. Condensate 20 is fed as reflux to high pressure column 17 (line 21) or—after being supercooled in countercurrent heat exchanger 23—to low-pressure column 18 (line 22). Oxygen-enriched bottom liquid 24 from high pressure column 17 is also supercooled (23) and fed at an intermediate level into low-pressure column 18 (operating pressure 1.3 to 2 bars, preferably 1.5 to 1.7 bars). Gaseous nitrogen 25 from the top of the low-pressure column can be withdrawn as product by line 26 after being heated in countercurrent heat exchanger 23 and in main heat exchanger 14.

At least a portion, i.e., generally 50–100 mol %, preferably 90–100 mol %, of the oxygen product generated in low-pressure column 17 is withdrawn in liquid form (line 27) and compressed by a pump 28, for example to 5 to 110 bars, preferably 20–40 bars, depending on the needed product pressure. Any balance of oxygen not compressed by pump 28 may be withdrawn as liquid product and/or taken directly from the low pressure column as gaseous product. The specific pressure provided by pump 28 depends on only the usage of the pressurized oxygen (downstream line 29). If the oxygen is used in a pipeline system, the provided pressure is about the pressure of that system; if the oxygen is further processed, e.g., in a chemical plant, the product pressure has to be designed slightly above the processing pressure of that plant. Alternatively or additionally, the pressure increase can be achieved by static height or by vaporization and pressure buildup in a liquid containing tank. The high-pressure liquid is vaporized in main heat exchanger 14 and withdrawn by line 29 as gaseous compressed product. Alternatively, product vaporization is possible in a condenser-vaporizer that is separate from the main heat exchanger (see, for example, EP-A-0 584 419).

In the example of FIG. 1, portion 30 of the purified feed air is used separately as a process stream that supplies the heat needed to vaporize the internally compressed liquid product. It is brought, in a first booster 31 and a second booster 33, to a pressure of 12 to 120 bars, preferably 15 to 60 bars. The compression heat is removed in a secondary coolers 32, 34 respectively. In main heat exchanger 14, the further compressed air condenses at least partially, preferably completely, against the vaporizing liquid oxygen and is passed via a throttling valve in line 35, into high pressure column 17. The feed point preferably lies several, e.g., 5–10, theoretical plates above the introduction of the main air (line 15).

A portion 36, e.g., 0–40, preferably 15–40 mol %, of the air to be separated in line 4 is branched from the conduit connecting boosters 31 and 33, fed at a temperature intermediate the temperatures at the warm and cold ends of the main heat exchanger 14 to a turbine 37 and work expanded from 10 to 60 bars, preferably 12 to 50 bars, to about the pressure of the high pressure column. The amount of air which flows through booster 33 is generally about 14–30 mol % of the air to be separated in line 4, and the amount of air flowing through booster 31 is the total of portion 36 and the amount compressed in booster 33. The mechanical energy thus generated in turbine 37 is used for booster 33. Expanded air 38 is fed together with main air 15 to high pressure column 17.

If the cold value produced in turbine 37 is not needed, the branch leading through turbine 37, second booster 33 and secondary cooler 34 can be omitted. The pressure needed to permit condensation of the further compressed stream, enabling it to be indirectly heat exchanged with vaporizing liquid product must then be achieved in the first (and only) booster 31.

Figure 2:
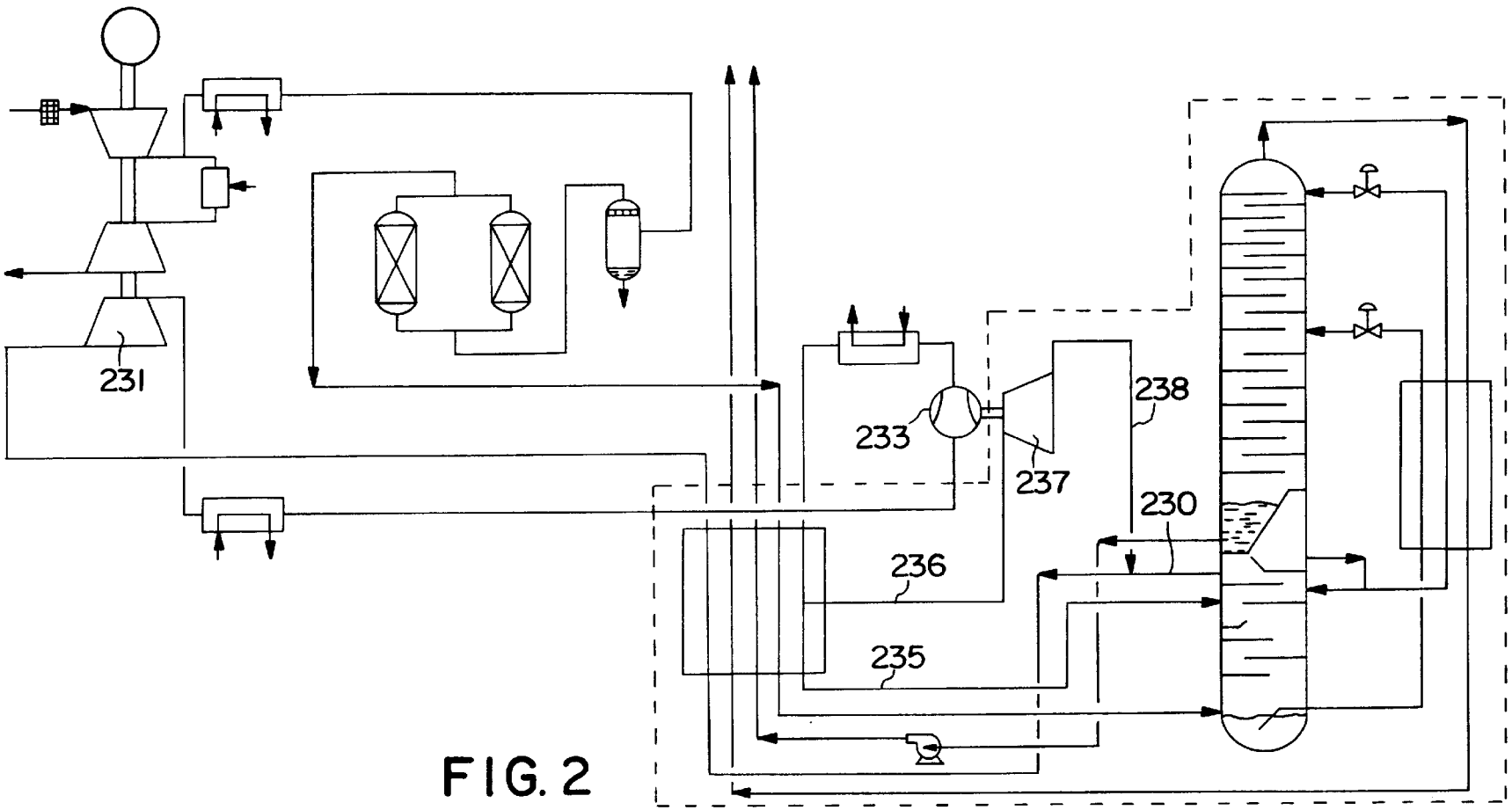
FIG. 2 is a schematic flow sheet of another embodiment with a nitrogen enriched stream as the secondarily compressed process stream.

The embodiment represented in FIG. 2 differs from FIG. 1 by the use of nitrogen 230 from high pressure column 17 instead of air to vaporize the liquid compressed oxygen. Nitrogen gas 230 is first warmed in main heat exchanger 14 to about ambient temperature and then brought, in first booster 231 and second booster 233, to a pressure of 12 to 120 bars, preferably 15 to 60 bars. A portion of the further compressed nitrogen is condensed at least partially, preferably completely, in main heat exchanger 14 against the vaporizing liquid oxygen and is throttled as it is fed into high pressure column 17 through line 235. Another portion 236 is expanded to about the pressure in the high pressure column in turbine 237 which drives second booster 233, and is fed back into the cycle by line 238. As in the first embodiment, it is possible to dispense with turbine-booster compressor combination 237/233 when the need for cold is limited or is covered in another way.

In both embodiments, gas turbine 9, air compressor 3 and the first booster 31/231 are preferably attached to a common shaft. Depending on if the mechanical energy produced in the gas turbine (taking into account the efficiency of the machines) is greater or less than the output needed from driven compressors 3, 31/231, a motor or generator can also be attached to the common shaft.

The mass transfer elements in high pressure column 17 and low-pressure column 18 can consist of conventional distillation plates, packing pieces (random packing) and/or structured packing. Also possible are combinations of various elements in one column. Because of the small pressure loss, structured packing is preferred in all columns, especially in the low-pressure column.

The pressure increases obtained in compressors 31, 33, 231, and 233, are set for each specific plant:

Boosters 33/233 use the work produced by turbine 37/237 and therefore effect a certain pressure increase, once the amounts of both streams are specified.

The pressure after booster 33/233 is determined by the fact, that the condensation temperature of the condensing fraction 35/235 plus the temperature difference over heat exchanger 14 has to be equal to the vaporization temperature of the oxygen at the chosen product pressure.

Otherwise, the vaporization of liquid oxygen would not work.

These physical properties are common to all "internal compression" processes, i.e., processes with the vaporization of pressurized liquid product.

Because of the heat exchange relationships (vaporization of oxygen at low pressure in 19 against nitrogen at the pressure of high pressure column on the one hand, and vaporization of oxygen at higher pressure in 14 against condensing air on the other hand) it is clear for each specific process, that the pressure of the condensing air must be higher than the high pressure column pressure.

The entire disclosure of all applications, patents and publications, cited above and below, and of corresponding German application 195 29 681.8, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

What is claimed:

1. In a process for air separation by low-temperature rectification in a rectifying column system (16) having at least one rectifying column (17, 18), comprising the following steps:

(a) compression (3) of an air stream (1) to at least the highest pressure of that prevailing inside the rectifying column system (16);

(b) dividing the resultant compressed air stream into a first partial stream (4) passed as feed air stream into the rectifying column system, and into a second partial stream (5) that is fed to a chemical reaction zone (6) as an oxidation agent;

(c) work expanding (9) at least a portion of waste gas (8) resulting from said chemical reaction zone (6);

(d) cooling (14) said first partial stream (4) to about saturation temperature and introducing resultant cooled partial stream (15) into said rectifying column system;

(e) withdrawing a liquid product stream (27) from said rectifying column system;

(f) increasing the pressure of the liquid product stream (27);

(g) further compressing (31, 33; 231, 233) a process stream (30, 230) of said air separation by low temperature rectification to a pressure above the highest pressure occurring in rectifying column system (16); and (h) vaporizing the liquid product stream by indirect heat exchange (14) with at least a portion (35, 235) of the further compressed process stream, the improvement comprising (i) employing at least a portion of the resultant mechanical energy generated in work expansion (9) of waste gas (8) from the chemical reaction zone (6) in step (c) for the compression of said process stream (30; 230) in step (g).

2. A process according to claim 1, wherein at least a portion of the mechanical energy generated during the work expansion (9) of waste gas (8) from the chemical reaction zone (6) in step (c) is used to compress the air stream (1) in step (a).

3. A process according to claim 1, wherein said process stream is a portion (30) of said first partial stream (4) of the compressed air stream.

4. A process according t claim 1, wherein the process stream is a nitrogen product stream (230) from said rectifying column system.

5. A process according to claim 1, wherein a portion (36; 236) of the further compressed process stream is work expanded (37; 237).

6. A process according to claim 5, wherein at least a portion of the resultant mechanical energy generated during the work expansion (37; 237) of the portion (36; 236) of the process stream is employed for further compression (33) of the process stream.

7. A process according to claim 1, wherein the rectifying column system has a high pressure column (17) and a low-pressure column (18) and the liquid product stream (27) is withdrawn from the bottom zone of the low-pressure column (18).

8. In a facility for low-temperature rectification of air, said facility comprising a rectifying column system (16) having at least one rectifying column (17, 18), and (a) an air compressor (3) having an inlet and outlet, (b) a first air line (4) that leads from the outlet of air compressor (3) through a main heat exchanger (14) to said rectifying column system (16);

(c) a second air line (5) that leads from the outlet of said air compressor (3) to a chemical reactor (6) having an inlet and outlet;

(d) a gas turbine (9) having an inlet connected to the outlet of chemical reactor (6);

(e) a liquid product line (27) for withdrawal of a liquid product stream from said rectifying column system (16);

(f) means (28) to increase the pressure of the liquid product stream;

(g) means (33,31; 231,233) to further compress a process stream (30; 230) of the facility for low-temperature rectification of air to a pressure above the highest pressure occurring in rectifying column system (16); and (h) means for vaporizing the liquid product stream by indirect heat exchange with at least a portion of the further compressed process stream, the improvement comprising (i) means to transfer at least a portion of the mechanical energy generated in gas turbine (9) to the means (31; 231) for further compressing said process stream.

9. A process according to claim 3, wherein said portion of said first partial stream is removed from said first partial stream prior to said cooling in step (d).

10. A process according to claim 3 wherein said portion of said first partial stream is split into a first portion and a second portion, said first portion is cooled by indirect heat exchange and then introduced into said rectifying column system, and said second portion is further compressed, cooled by indirect heat exchange, and then introduced into said rectifying column system.

11. A process according to claim 1, wherein said liquid product stream is an oxygen product stream.

12. A process according to claim 7, wherein said resultant cool partial stream of step (d) is introduced into said high pressure column of said rectifying column system.

13. A process according to claim 7, wherein the process stream is a nitrogen product stream from said high-pressure column of said rectifying column system.

14. A process according to claim 4, where said nitrogen product stream, prior to compression in step (g), is cooled by indirect heat exchange.

15. A process according to claim 4, wherein said nitrogen product stream after compression in step (g) is heated by indirect heat exchange and then divided into a first portion and a second portion.

16. A process according to claim 15, wherein said first portion is worked expanded and then recycled to the nitrogen product stream removed from the rectifying column system, and said second portion is cooled by further indirect heat exchange and then introduced into said rectifying column system.

17. A process according to claim 16, wherein at least a portion of the resultant mechanical energy generated during the work expansion of said first portion is employed for compression of said nitrogen product stream.

18. A facility according to claim 8, wherein said air compressor, said gas turbine, and said means to compress a process stream are all attached to a common shaft.

* * * * *